US007871071B2

(12) United States Patent
Gnägi et al.

(10) Patent No.: US 7,871,071 B2
(45) Date of Patent: Jan. 18, 2011

(54) GROUPING DEVICE

(75) Inventors: Christian Gnägi, Zudarl (CH); Reto Settmacher, Rubigen (CH); Patrick Schöpfer, Heitenried (CH)

(73) Assignee: Kern AG, Konolfingen (CH)

( * ) Notice: Subject to any disclaimer, the term of this patent is extended or adjusted under 35 U.S.C. 154(b) by 471 days.

(21) Appl. No.: 11/887,951

(22) PCT Filed: Mar. 31, 2006

(86) PCT No.: PCT/CH2006/000184

§ 371 (c)(1),
(2), (4) Date: Oct. 5, 2007

(87) PCT Pub. No.: WO2006/108308

PCT Pub. Date: Oct. 19, 2006

(65) Prior Publication Data

US 2009/0058000 A1 Mar. 5, 2009

(30) Foreign Application Priority Data

Apr. 12, 2005 (CH) ..... 661/05

(51) Int. Cl.
*B65H 31/20* (2006.01)

(52) U.S. Cl. ..... 271/223; 271/171

(58) Field of Classification Search ..... 271/171, 271/223, 306
See application file for complete search history.

(56) References Cited

U.S. PATENT DOCUMENTS 3,815,897 A * 6/1974 Hoehl et al. ..... 271/9.13
4,204,670 A * 5/1980 Traister ..... 271/287
4,431,322 A * 2/1984 Nally et al. ..... 400/605
4,824,090 A * 4/1989 Booth et al. ..... 271/3.03
5,083,769 A * 1/1992 Young, Jr. ..... 271/280
5,794,931 A * 8/1998 Heilman et al. ..... 271/303
6,073,925 A * 6/2000 Sato ..... 271/171
6,290,226 B1 * 9/2001 DeFigueiredo et al. ..... 271/223
6,644,657 B2 * 11/2003 Wright et al. ..... 271/242
6,776,409 B2 * 8/2004 Cook ..... 271/189
7,121,544 B2 * 10/2006 Masotta et al. ..... 271/209
7,451,979 B2 * 11/2008 Masotta et al. ..... 271/209
2002/0109289 A1 * 8/2002 Oikawa ..... 271/298
2004/0021265 A1 * 2/2004 Tan et al. ..... 271/171
2006/0056953 A1 * 3/2006 Masotta et al. ..... 414/789.9

FOREIGN PATENT DOCUMENTS

EP 0 445 494 A2 11/1991
EP 0 932 129 A2 7/1999
GB 1 274 322 5/1972

* cited by examiner

*Primary Examiner*—Stefanos Karmis
*Assistant Examiner*—Howard Sanders
(74) *Attorney, Agent, or Firm*—The Nath Law Group; Jerald L. Meyer; Robert T. Burns

(57) ABSTRACT

The invention relates to a grouping device (1) for processing a fast running series of individual sheets, said grouping device having several conveying means for transporting said sheets which pass at least one delivery area and at least one conveying area. Said conveying means have at least one transport means (10; 15; 16) and at least one removal means (14), wherein said device comprises at least one grouping table (18; 19), said delivery area as well as the stacking area having an adjustable length and said transport means (10) acting exclusively in said conveying area of said sheets in order to avoid smearing of said sheets.

18 Claims, 4 Drawing Sheets

GROUPING DEVICE

The present invention generally relates to a grouping device for processing individual sheets or stacks of a plurality of sheets, and specifically to a multiplex grouping device for processing a fast running series of individual sheets, or stacks of a plurality of sheets.

Such grouping or collating devices are most often used in paper processing production lines, where they receive and arrange individual paper sheets cut to size (format), or stacks of a plurality of such papers. In order to increase the turnover device embodiments can also be designed as a multiplex grouping device. These devices are used, for example, when brochures, books or documentations are to be assembled from multiple individual sheets. To this end, varying formats need to be considered, too, i.e. it is intended to employ the same machine for papers of differing sizes, if possible without the necessity of manual changeover, adaptation or adjustment that would slow down processing and render it more expensive. For systems of some size the working mode should be as automated as possible in view of the economy of operation. Such an automated high speed processing line is a network of a plurality of individual devices that work independently in a specific segment of the processing line and they comprise: printing devices for endless paper webs, longitudinal and transverse cutting devices, collating machines, seaming machines, adhesive or binding units, etc.

For safe operation at high output rates it is necessary to expose the paper sheets as little as possible to force effects and to convey them with care. This can be achieved by gathering the sheets with the transport means that convey the papers. Furthermore, it is necessary to guide the sheets into different processing routes. For this purpose an allocating device is needed. Autonomous operation of such a facility requires a control that "knows" when it has reached which of the sheets. This allocation is a feature of a multiplex grouping device because single grouping devices do not differentiate between processing routes. However, a multiplex grouping device can be operated as a single grouping device without effort by having said allocation device (switching gate) guiding the sheets of one group in the same direction.

The sheets guided to a specific processing route are collated among each other, i.e. guided to the same stack and arranged. Various mechanisms have been tried in the past for controlling stack positioning.

With devices according to prior art it is unsatisfactory that loose sheets are either deflected by mechanical force effects which may lead to a paper jam and interruption of processing or by leaving downward movement of the sheet to gravity as this will also slow down processing.

Accordingly, it is a first object of the invention to provide a device that guides paper sheets in a controlled manner without subjecting them to the impact of excessive force. According to the invention this object is solved by means of a first embodiment of the invention as specified in claim 1 while avoiding the disadvantages of the prior art at the same time by guiding the assembled sheets by means of a controlled air jet into the desired stack position. In this way the sheets do not come into contact with any parts of the device and are not endangered of being crinkled and/or causing a paper jam.

Experiments by applicant have shown that it makes sense to take up the sheets in a first segment of the device after transverse separation and to deliver them to a grouping table in a controlled manner and without smearing. This first segment of the device is termed delivery area, or DA for brevity. Guide means are provided in this area that are not mobile and merely serve to reliably deliver the loose sheets. To achieve safe uptake of the sheets for further processing it is necessary to deflect the transport means to different locations in order to cope with the different format lengths. For this purpose a deflector unit is provided that is mobile in the processing direction of the device. This deflector unit forms the beginning of the subsequent area, the conveying area, or CA for short, that is characterized by the presence of transport means. It is also necessary to reproduce the shift in the subsequent segment of the device, the so-called grouping segment, by providing a further corresponding deflector unit on each grouping table.

For this reason, it is a second object of the invention to provide a grouping device for processing sheets of different weight and formats as well as in any desired group size. For this purpose adjustments or settings of the device are necessary that are simple and that can be implemented without personnel action.

These objects are solved according to the invention by a device according to claim 1. Preferred embodiments are subject of claims 2 to 10.

Accordingly, the present invention provides for a device for grouping sheets, or for collating, that is composed of two segments: a delivery table and one or more grouping tables. Only one grouping table is present in a single grouping device; however, the embodiment of a multiplex grouping device with two grouping tables is preferred.

After passing the transverse or cross-cutting separator the individual sheets are delivered stepwise to a transport means, preferably in the form of mobile endless belts. The delivery position depends on the sheet length. For adjusting such length the conveying means for moving the transport means must be mobile. The sheets are located throughout the complete length of the delivery table and are encased by a stationary static guide means. In line with the invention, stationary belts are preferred as static guide means that are provided as pairs and determine the path of the sheets in the device. A device according to the invention has a delivery table having two symmetrically arranged transport means, the sheets being gathered at the axis of symmetry between the synchronously running transport means. The length of the transport and guide means does not change when the deflector unit is adjusted. The length adjustment of the delivery area is achieved by moving the deflector unit. Depending on the distance the deflector unit is moved in the direction towards the end of the delivery table, a correspondingly longer format can be accommodated, and the conveyance area can be shortened. Importantly, both transport means should operate synchronously and be of the same length, in other words have the same position. For achieving this end, the deflector means for both symmetric transport means are arranged together in one mobile and movable deflector unit. In this manner, adjustments of the length of the transport means can only be effected at the same time for both transport means.

Next, the sheets leave the delivery table and—in the case of the embodiment of a double grouping device—reach a switch gate that allocates the desired number of sheets to the corresponding grouping table. Once the specific number of sheets reaches the selected grouping table the gate switches over and serves the other grouping table. It is understood that the counting of the sheets and the switching of the gate are actions requiring a control. Such control comprises sheet delivery, counting of the desired number of sheets, and switching of the gate after the desired number of sheets has passed by. However, such control devices are known to the skilled person and do not require further illustration.

The sheets allocated in this manner are subsequently taken up by corresponding transport means. Next, the sheets are again taken up by the guide means that are preferably formed by stationary belts. The length of this conveying area is determined by the format length.

Experiments by applicant have demonstrated that the problem of the demanded variable deposit area for the sheets can be solved most easily and cost efficiently by belts. Just as for the delivery table there are rollers on a mobile deflector unit that is the preferred deflector means which can be moved together with the stationary belts. Here the length adjustment is also implemented by mobile rollers that can accept different belt lengths from a backside loop. Throughout the entire length of the conveying area sheets positioned thereon are moved by the transport means in the direction of the deflector unit with the rollers. Upon arrival, the sheets enter an area where they are deposited on top of or beneath the stack, depending on the desired arrangement. For that reason this area is also termed the stacking area, or SA for short. The rear edge of the stack is lifted or lowered by means of an air jet so that the next sheet can be inserted into the desired position. For this purpose the sheets in the stacking area stay in position until all sheets of the group have been arranged. The sheets leave the device in the correct direction by the feed force of removal means. In the area of the air jet (the so-called air bar) the stationary belts are deflected up and down in order not to disturb the sorting in the stacking area. After leaving the air bar, the sorted sheets are again deposited on the stationary belts where they can subsequently be taken up by the removal means. Further processing of the arranged groups of sheets is not part of this invention.

When reference is made to stationary belts, this is intended to refer to two distanced belts that form a guide path for the sheets.

If the deflector unit with the deflector rollers was moved further back at the delivery table, this must also be reflected in a corresponding adaptation of the grouping tables. However, here the corresponding adaptation manifests itself in moving the deflector unit to the front, i.e. to the intake.

The roller groups of the deflector units are partly coupled to each other and must therefore be fixed in the same position during operation. The two larger rollers of a deflector unit effect the forward feed of the sheets with the air jets in the air bar. The two smaller rollers merely serve deflection of the transport means.

After the sheets in the stacking area have been arranged by the air bar the complete group is conveyed to the output where it is taken up by removal means and transported outside. The control unit ensures that loading of sheets that belong to the same group is not interrupted by sheets destined for another grouping table. The delivery to the other table does not take place until the front edge of the last sheet has passed the gate. For the deflector units of the grouping tables uptake of a specific length of the transport means it is no longer relevant while adaptation of the transport means to specific format sizes becomes essential.

Continuous feeding is provided by the co-action of the conveying means that are located at the borders of the delivery table which is the respectively active grouping table.

Due to the parallel arrangement of both grouping tables it is possible to switch to the other table during processing in a time-saving manner when the first table is occupied. This requires that the gate "knows" the point in time when the last document of a series or sequence to be arranged has passed and switching is needed. At the position where the first document of such a series or sequence is to enter the air bar the stationary belt is deflected at an axle and the document(s) is/are released. The function of the stationary belt has now been accomplished and it is moved sideways so as not to disturb further processing. At the inside of the air bar, the documents of a series are arranged as described above. The finished stack is now taken up by the removal means, the stationary belt being returned by a further axle and the stack being moved to the removal means. Then, the finished stacks of both stacking areas are discharged in one level. The subsequent processing steps may include, for example, crimping, gluing, stapling of the loose sheets. However, these additional steps are well known to those skilled in the art and do not require further explanation. Moreover, they do not constitute subject-matter of the present invention.

The main advantages of the device according to the invention are: restriction of the movement of paper segments by stationary belts, ease of adjusting and setting the stationary belts to the needs of grouping without smearing, and air control of the stack position of the documents. A device equipped with these features is capable of arranging documents of any format simply and fast without any substantial strain on the documents.

For a better understanding of the invention and for illustrating the preceding sections the invention will be explained with reference to drawings wherein:

FIG. 1*a* is a schematic side view of a device according to the invention, wherein the stationary belts are highlighted and the alternative positions of the mobile deflector units of the delivery table and the grouping tables are shown as dashes.

FIG. 1*b* is a schematic side view of a device according to the invention, wherein the mobile belts are highlighted and the alternative positions of the mobile deflector units of the delivery table and the grouping tables are shown as interrupted lines.

In the following a preferred embodiment of the invention will be illustrated in detail with reference to FIGS. 1*a* and 1*b*.

Figure 1A:
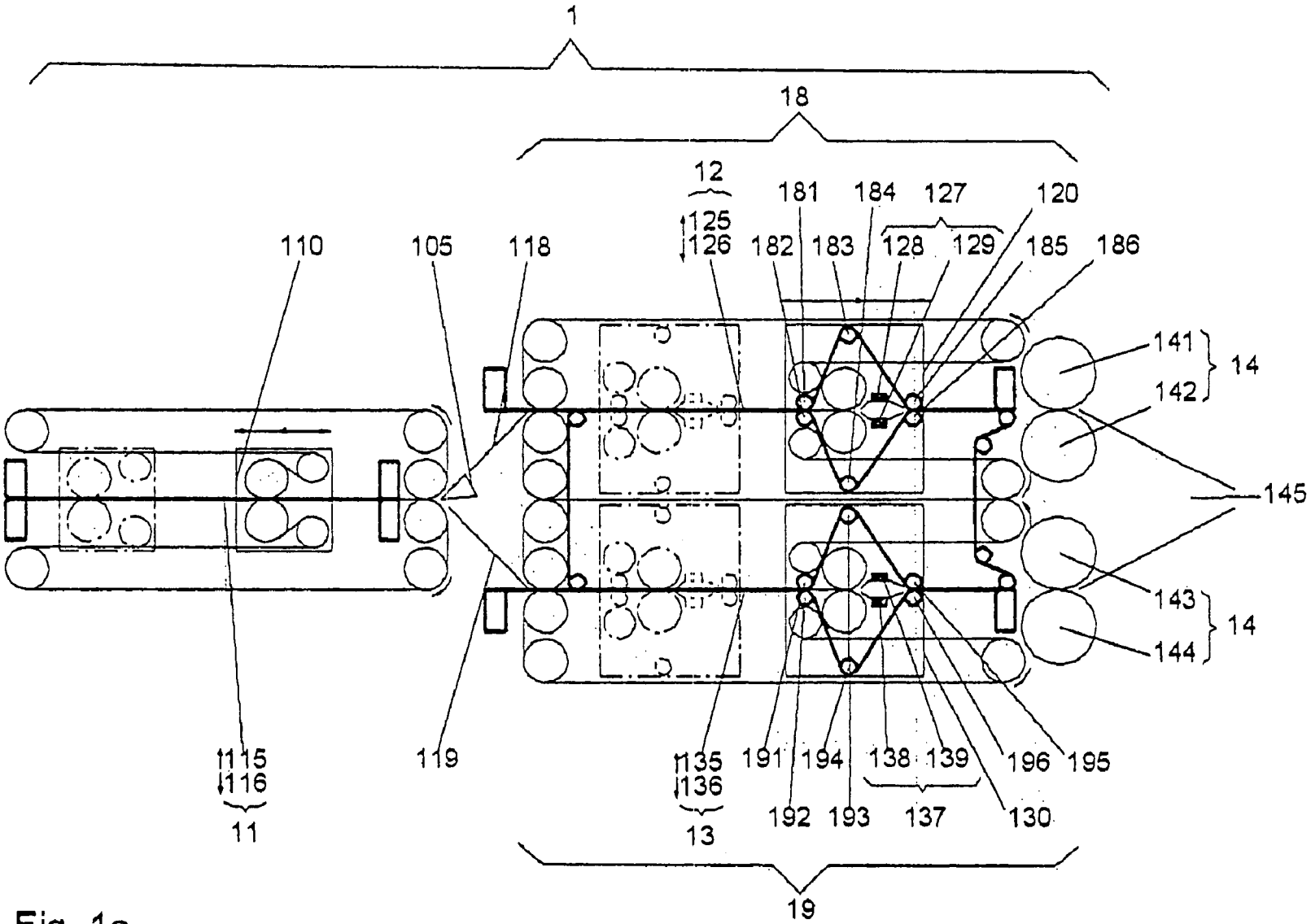
Figure 1B:
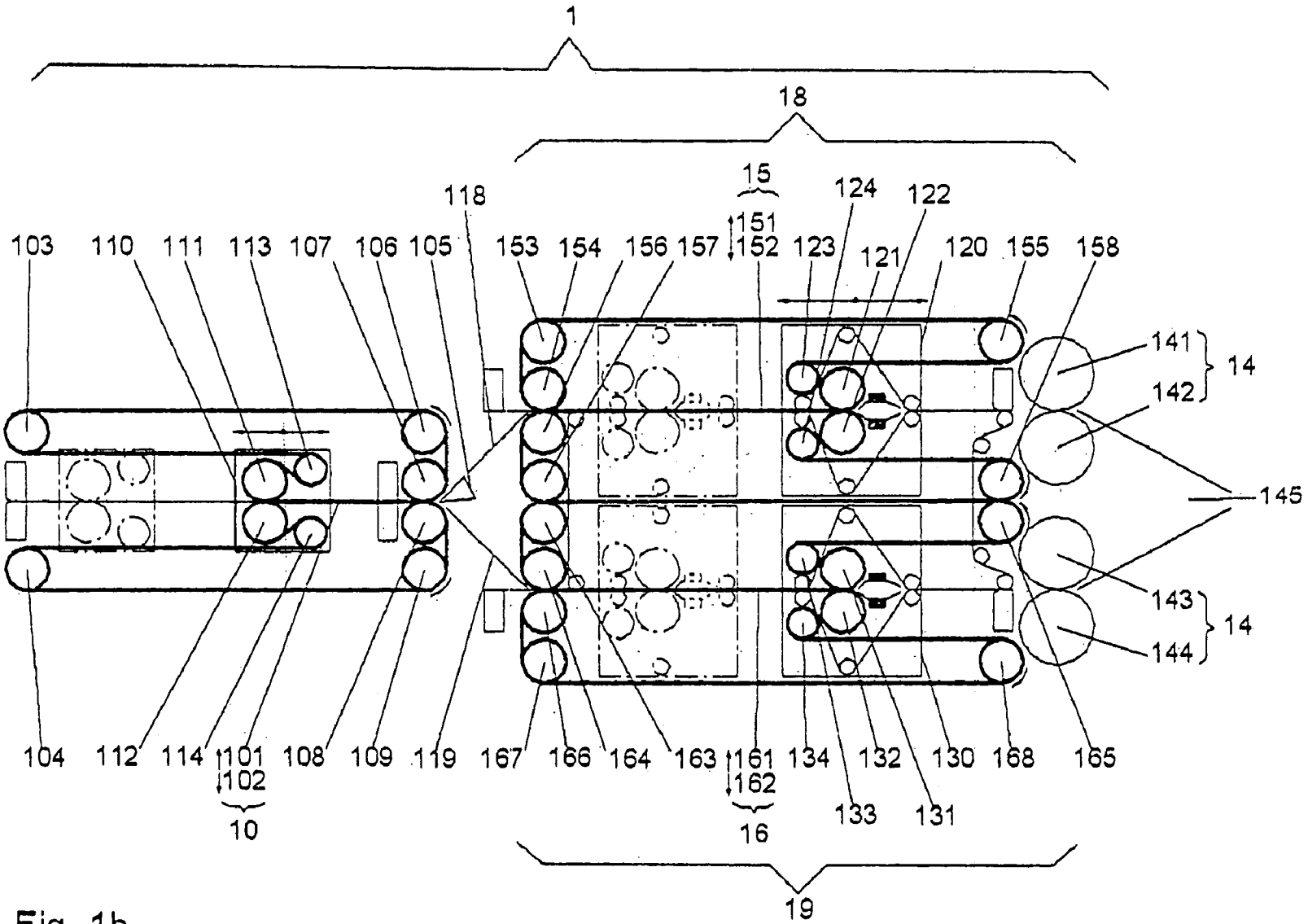

Both FIG. 1*a* and FIG. 1*b* show the device according to the invention 1 as a side view. In FIG. 1*a* the stationary belts 115, 125,135 (as well as their counterparts 116, 126, 136) of the guide means 11, 12, 13 are highlighted whereas in FIG. 1*b* the transport means 10, 15 and 16 with the mobile belts 101, 102; 151, 152; 161, 162 are highlighted. The sheets of a series to be arranged enter the guide means 11 in the delivery area (DA) of device 1. They are positioned between the stationary belts 115 and 116 (guide means 11) and are moved by the mobile belts 101 and 102 of the transport means 10. A mobile deflector unit 110 is moved depending on the format length. The deflector unit 110 comprises a first deflector roller 111 or 112 and a second deflector roller 113 or 114 for the transport means 10 having the upper and lower mobile belt 101 and 102. Both mobile belts 101 and 102 of the transport means are arranged laterally reversed to the plane of the guide means 11 with the stationary belts 115, 116. The upper mobile belt 101 of the transport means 10 is an endless loop strained between pulling means 106 and 107, a thrust means 103 and the deflector rollers 111 or 113. In analogy the lower mobile belt 102 of the transport means 10 is arranged around pulling means 108 or 109, a thrust means 104 and the deflector rollers 112 or 114. By moving the deflector unit 110 the required format lengths can be adjusted.

Next, the sheets of a series are delivered to a grouping device in the form of grouping tables 18 or 19. A gate 105 effects the allocation to the chosen grouping table that stays in the same position until all sheets of a series have been delivered. In the following additional sheets belonging to the next series can be gathered from the delivery table. For doing so gate 105 takes on a different position. By way of baffle plates 118 or 119 the sheets of a series either arrive at the upper grouping table 18 or at the lower grouping table 19. Upon arrival the sheets are positioned between the stationary belts 125 and 126 or 135 and 136 of guide means 12 or 13 of the respective grouping tables. For moving the sheets gathered in this way mobile belts 151 and 152 or 161 and 162 of transport means 15 or 16 are employed that are arranged in endless loops in analogy to the delivery table. In both grouping tables 18 or 19 the mobile belts 151 and 152 or 161 and 162 of the transport means 15 or 16 are arranged laterally reversed and stretched between pulling means 155 and 158 or 165 and 168, thrust means 153, 154 and 156, 157 or 163, 164 and 166, 167. For being capable of adapting the delivery table mobile deflector units 120 or 130 are present on both grouping tables 18 or 19, so that the deflector unit of grouping tables 120 or 130 is also to be moved closer to gate 105 when the deflector unit 110 at the delivery table is moved close to gate 105. This is the great advantage of the guide means 11, 12, 13 with the stationary belts 115, 116; 125, 126; 135, 136 that allow for the easy adjustment to different formats without greater endeavours.

The deflector units 120 or 130 of the grouping tables are composed identically. They comprise deflector rollers 121, 122, 123 and 124 or 131, 132, 133 and 134 for the transport means 15, 16 with the mobile belts 151, 152 or 161 and 162 as well as for guide means 12, 13 with stationary belts 125, 126 or 135 and 136. The stationary belts 125 and 126 or 135 or 136 that were always arranged lying side by side now diverge in the area of the deflector unit 120, 130 to provide space for the grouping of the sheets: at a deflector roller 181 the upper stationary belt 125 of the upper grouping table 18 is strained upwards to a deflector roller 183 to subsequently return around a deflector roller 185 and to extend to the output boundary of a pair of removal means 141, 142. The lower stationary belt 126 is deflected downwards at deflector roller 182, returns at deflector roller 184 and meets the upper stationary belt 125 again at deflector roller 186. At the lower grouping table 19 the upper stationary belt 135 continues upwards at deflector roller 191, again turns downward at deflector roller 193 towards deflector roller 195 and the lower stationary belt 136. The lower stationary belt 136 turns downwards at deflector roller 192 and reverses its running direction at deflector roller 194 in order to return to the upper stationary belt 135 at deflector roller 196 and to extend together with this to the output boundary of a pair of removal means 143, 144.

There are devices 127 or 137 between each of the stationary belts 125 and 126 or 135 and 136 in the area of the deflector units 120 or 130 for deflecting loose sheets, the subsequent sheet or sheets being capable of being moved above or beneath these sheets. This is implemented by means of jets that blow air onto the stack for deflecting said stack in the desired direction. The jets are located in so-called air bars 128 and 129 or 138 and 139. In this way the sheets of a series are arranged. The arranged stack is then conveyed by removal means 141 and 142 or 143 and 144 in the direction of the output 145, where the stack is released on the same level.

Figure 2:
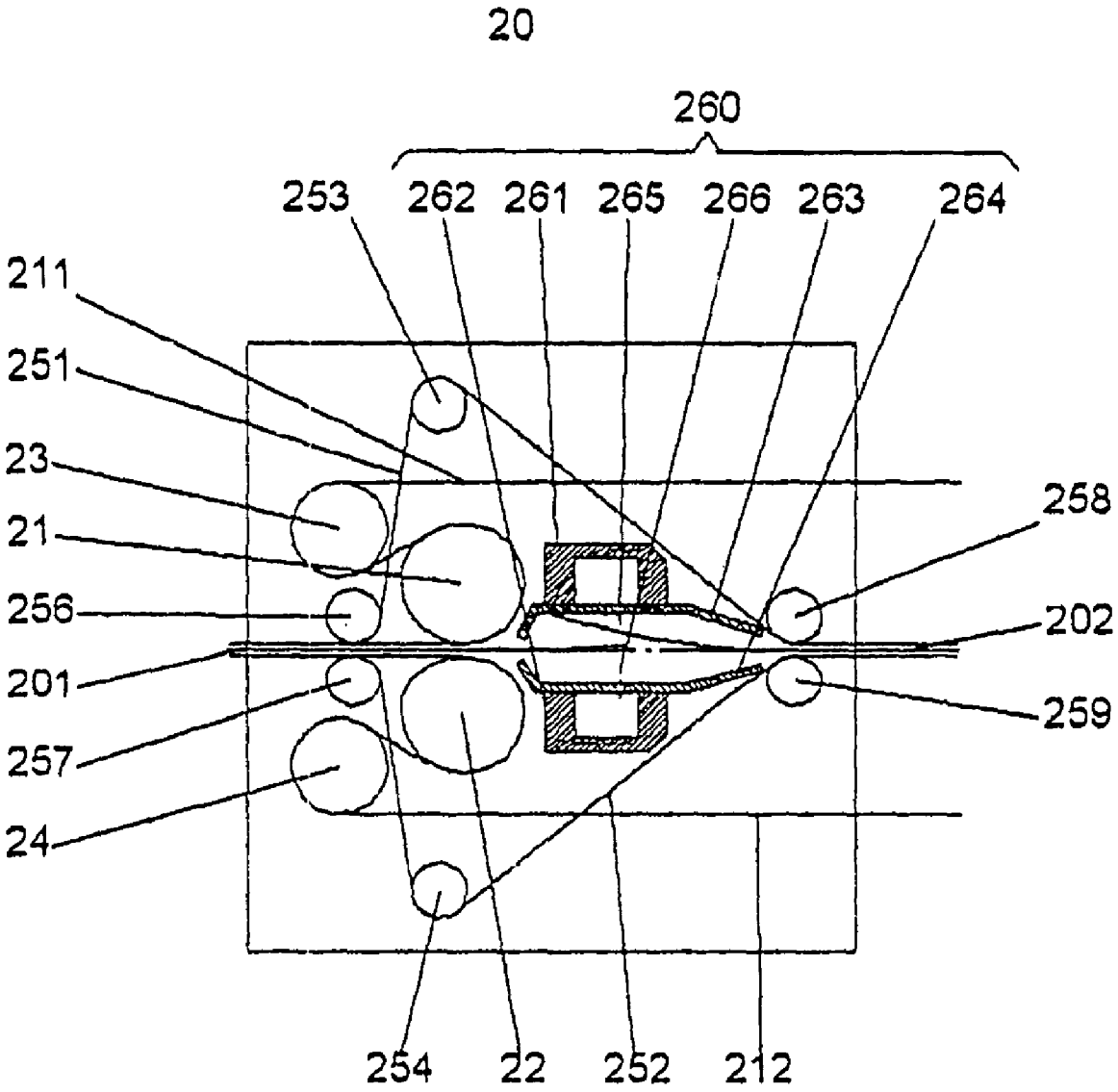
FIG. 2 is a schematic side view of the actual stacking area according to the invention, i.e. the mobile deflector unit with the air bar.

The principle of deflecting the sheets is better illustrated in FIG. 2 wherein an enlarged deflector unit 20 in the stacking area is illustrated. The deflector unit 20 that can be moved in horizontal direction contains a deflector region 260 that is also called an air bar. This bar has two stacking plates 263 and 264 provided with jets 265, 266 through which a corresponding blower 261 or 262 can dispatch air and thereby locally exercise a gentle force on a sheet 202 or a stack of sheets that is already partially located between stationary belts 251 and 252 and beyond a pair of deflector rollers 258 and 259. In the moment of deflection of said sheet 202 a subsequent sheet 201 is inserted, thus achieving a stacking of the sheets. The resulting stacking order depends on the direction into which the air is blown in each specific case. The stacking plates 263 and 264 are dimensioned so that one of them can receive a series. In this illustration it is the fact that the sheets in the air bar 260 are not moved by any conveying means and that the charging of a mentioned stacking plate 263 or 264 is waited for until the removal means (not illustrated) start functioning and remove the arranged stacks that is particularly apparent.

The sheets are moved by mobile transport means 211 and 212 into the air bar 260. These are guided by deflector rollers 21 and 23 or 22 and 24 and leave the air bar 260 before the sheets reach the area of the stacking plates 263 and 264. The stationary belts 251 and 252 are already guided around deflector rollers 256 and 257, return their running direction at the position of their greatest distance to each other at deflector rollers 253 or 254 and return at the end of the stacking plates 263 and 264 in order to get back together in front of the deflector rollers 258 and 259.

Figure 3:
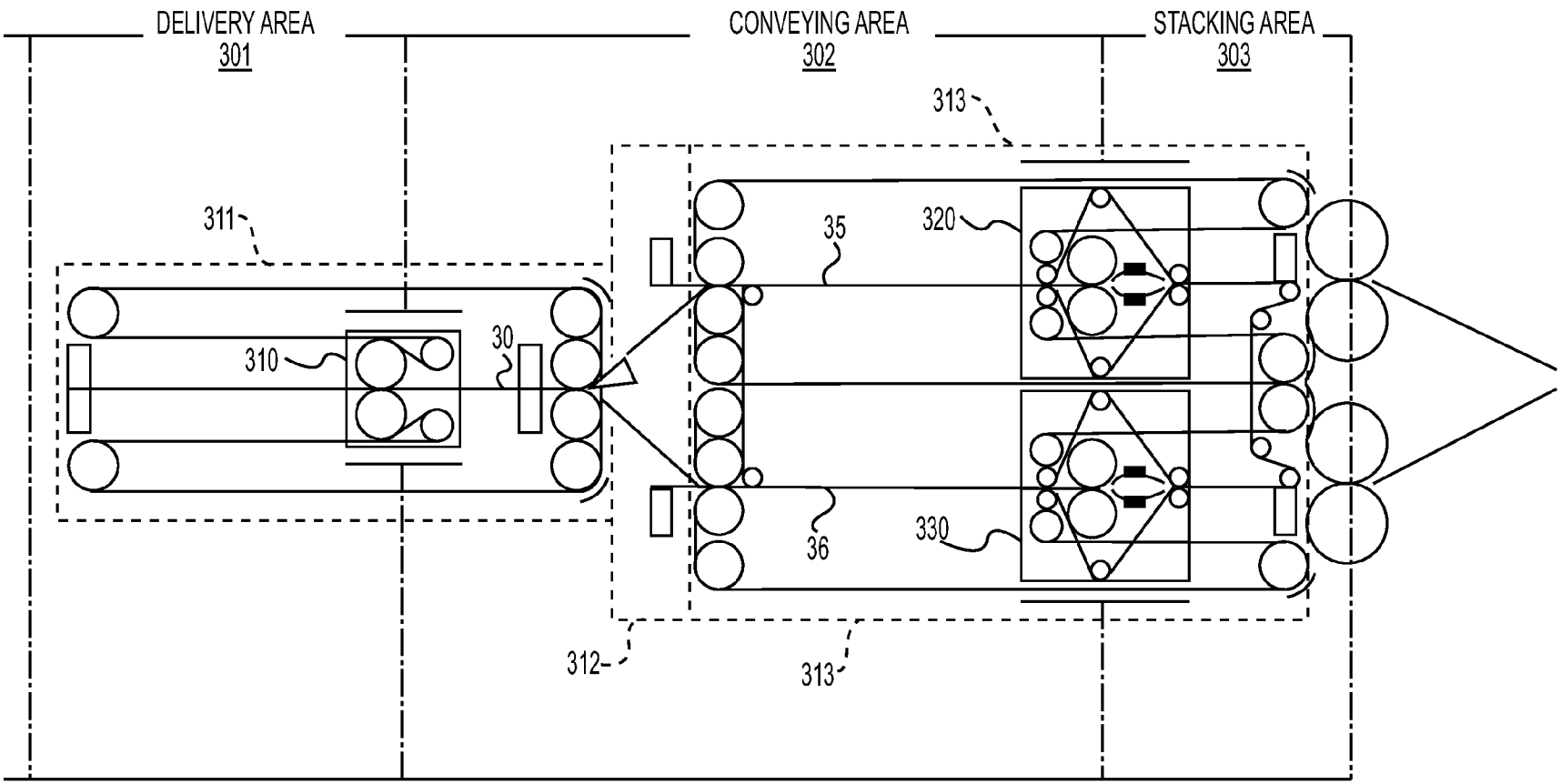
FIG. 3 is a schematic side view of a device according to the invention showing the grouping of the device into segments.

FIG. 3 illustrates the segmentation of the device according to the invention into a delivery area 301 that extends from the sheet intake until the deflector unit 310 of a delivery table, a stacking area 303 that designates the area between deflector units 320, 330 of grouping table and a conveying area 302 located between said deflector unit 310 of the delivery table and the deflector units 320, 330 of grouping tables. It is noted that all transport means are positioned exclusively in the conveying area 302. Also, a gate is arranged in the conveying area that connects the delivery table with the grouping table (s).

The control of the forward feed of the sheets by mobile transport means and the conveying means, the control of the gate and the removal or the arranged stacks are known to people skilled in the art of paper collation and do not need to be further illustrated herein. The means for loading the sheets are designed for stepwise operation. Also, the means for the transport of the sheets at the delivery table as well as at the grouping tables are adapted for stepwise operation. For a smooth operation of all these partial movements a central control unit is required that interacts with different sensors and actors distributed across the whole device. The sequence of individual actions is determined by the programming of the control unit that are to be chosen depending on the desired operation mode, the group size to be arranged, the sheet format, the initial arrangement of the sheets and more. Merely the adjustment of the deflector units at the delivery table and the grouping tables must be carried out by skilled personnel.

It is apparent that many changes and modifications of the invention are feasible within the scope of the invention without deviating from the scope of the claims.

The invention claimed is:

1. A grouping device for processing a fast running series of individual sheets, the grouping device comprising:

an adjustable-length delivery area;

at least one delivery table at least partially located in the adjustable-length delivery area;

a conveying area adjacent to the adjustable-length delivery area;

an adjustable-length stacking area adjacent to the conveying area;

at least one grouping table at least partially located in the adjustable-length stacking area;

at least one transport means for transporting sheets from the adjustable-length delivery area to the adjustable-length stacking area via the conveying area; and at least one removal means for removing sheets from the adjustable-length stacking area; wherein:

the at least one transport means is configured to capture the individual sheets from the at least one delivery table at the start of the conveying area, guide the individual sheets to at least one grouping table and further convey the individual sheets in the direction of adjustable-length stacking area in a manner that avoids smearing of the individual sheets, and the at least one grouping table has at least one controlled air jet deflector configured for inserting individual sheets or stacks of a plurality of sheets to be arranged by compressed air above or beneath a stack already present.

2. The grouping device according to claim 1, wherein the at least one delivery table and the at least one grouping table have guide means controlled by a mechanical deflector so that no change in length of the at least one delivery table or the at least one grouping table is required for adjustment.

3. The grouping device according to claim 1, wherein the at least one removal means remove the arranged sheets.

4. The grouping device according to claim 1, wherein the at least one transport means comprises at least one pair of revolving belts.

5. A grouping device for processing a fast running series of individual sheets, the grouping device comprising:

an adjustable-length delivery area;

at least one delivery table at least partially located in the adjustable-length delivery area;

a conveying area adjacent to the adjustable-length delivery area;

an adjustable-length stacking area adjacent to the conveying area;

at least one grouping table at least partially located in the adjustable-length stacking area;

at least one transport means for transporting sheets from the adjustable-length delivery area to the adjustable-length stacking area via the conveying area; and at least one removal means for removing sheets from the adjustable-length stacking area; wherein:

the at least one transport means is configured to capture the individual sheets from the at least one delivery table at the start of the conveying area, guide the individual sheets to at least one grouping table and further convey the individual sheets in the direction of adjustable-length stacking area in a manner that avoids smearing of the individual sheets, the at least one delivery table and the at least one grouping table have guide means controlled by a mechanical deflector so that no change in length of the at least one delivery table or the at least one grouping table is required for adjustment, and the guide means comprise at least one pair of guide belts.

6. The grouping device according to claim 5, wherein the at least one removal means is configured to remove the individual sheets.

7. The grouping device according to claim 6, wherein the at least one delivery table comprises a deflector unit configured to move along the conveying direction of the at least one delivery table, wherein deflections for the at least one transport means are guided by a mechanical deflector such that no change in length of the at least one delivery table is needed for adjustment.

8. The grouping device according to claim 5, wherein the at least one transport means comprises at least one pair of revolving belts.

9. The grouping device according to claim 8, wherein the at least one delivery table comprises a deflector unit configured to move along the conveying direction of the at least one delivery table, wherein deflections for the at least one transport means are guided by the deflector unit such that no change in length of the at least one delivery table is needed for adjustment.

10. The grouping device according to claim 8, wherein the at least one grouping table comprises:

one or more deflector units; and one or more deflector unit rollers, the one or more deflector unit rollers configured to provide space for the at least one transport means, said guide means and said deflector configured for selecting a grouping side that can be moved along a conveyance direction of the at least one grouping table, wherein the at least one transport means is guided by at least one mechanical deflector so that no change in length of the at least one grouping table is needed for adjustment.

11. The grouping device according to claim 5, further comprising one or more deflector unit rollers, the one or more deflector unit rollers configured to provide space for the at least one transport means, wherein guide means and said one or more deflector unit rollers are configured for selecting a grouping side that can be moved along a conveyance direction of the at least one grouping table, and wherein the at least one transport means is guided by at least one mechanical deflector so that no change in length of the at least one delivery table or the at least one grouping table is needed for adjustment.

12. The grouping device according to claim 11, wherein the removal means comprises pairs of rollers.

13. The grouping device according to claim 5, wherein the at least one removal means at the at least one grouping table comprise at least one pair of rollers.

14. The grouping device according to claim 5, wherein the at least one removal means is configured to remove the individual sheets.

15. The grouping device according to claim 5, wherein the at least one removal means is configured to remove the individual sheets.

16. The grouping device according to claim 5, wherein the at least one transport means comprises at least one pair of revolving belts.

17. A grouping device for processing a fast running series of individual sheets, the grouping device comprising:

an adjustable-length delivery area;

at least one delivery table at least partially located in the adjustable-length delivery area;

a conveying area adjacent to the adjustable-length delivery area;

an adjustable-length stacking area adjacent to the conveying area;

at least one grouping table at least partially located in the adjustable-length stacking area;

at least one transport means for transporting sheets from the adjustable-length delivery area to the adjustable-length stacking area via the conveying area; and at least one removal means for removing sheets from the adjustable-length stacking area, wherein:

the at least one transport means is configured to capture the individual sheets from the at least one delivery table at the start of the conveying area, guide the individual sheets to at least one grouping table and further convey the individual sheets in the direction of adjustable-length stacking area in a manner that avoids smearing of the individual sheets, the at least one delivery table comprises a deflector unit configured to move along the conveying direction of the at least one delivery table, and deflections for the at least one transport means are guided by a mechanical deflector such that no change in length of the at least one delivery table is needed for adjustment.

18. The grouping device according to claim 17, wherein the at least one grouping table comprises:

one or more deflector units; and one or more deflector unit rollers, the one or more deflector unit rollers configured to provide space for the at least one transport means, said guide means and said deflector configured for selecting a grouping side that can be moved along a conveyance direction of the at least one grouping table, wherein the at least one transport means are guided by at least one mechanical deflector so that no change in length of the at least one grouping table is needed for adjustment.

* * * * *